US012168540B2

(12) United States Patent
Reiser et al.

(10) Patent No.: US 12,168,540 B2
(45) Date of Patent: Dec. 17, 2024

(54) PASTRY BAG AND METHOD OF MANUFACTURING THEREOF

(71) Applicant: Rich Products Corporation, Buffalo, NY (US)

(72) Inventors: Ralf Reiser, Orchard Park, NY (US); Michael Paul Piatko, West Seneca, NY (US); Seung-Yeol Hong, Amherst, NY (US)

(73) Assignee: Rich Products Corporation, Buffalo, NY (US)

( * ) Notice: Subject to any disclaimer, the term of this patent is extended or adjusted under 35 U.S.C. 154(b) by 762 days.

(21) Appl. No.: 17/281,168

(22) PCT Filed: Oct. 4, 2019

(86) PCT No.: PCT/US2019/054682
§ 371 (c)(1),
(2) Date: Mar. 29, 2021

(87) PCT Pub. No.: WO2020/072894
PCT Pub. Date: Apr. 9, 2020

(65) Prior Publication Data

US 2021/0347506 A1 Nov. 11, 2021

Related U.S. Application Data

(60) Provisional application No. 62/741,154, filed on Oct. 4, 2018.

(51) Int. Cl.
*B65B 9/08* (2012.01)
*B65B 9/20* (2012.01)
(Continued)

(52) U.S. Cl.
CPC ..... *B65B 9/08* (2013.01); *B65B 9/20* (2013.01); *B65D 35/08* (2013.01); *B65D 35/36* (2013.01); *B65D 75/5866* (2013.01)

(58) Field of Classification Search
CPC ..... B65B 9/08; B65B 9/20; B65D 35/08; B65D 35/36; B65D 75/5866
See application file for complete search history.

(56) References Cited

U.S. PATENT DOCUMENTS 2,390,822 A * 12/1945 Wren ..... B65D 75/5833 383/203
3,790,331 A 2/1974 Backer
(Continued)

FOREIGN PATENT DOCUMENTS

CN 202986650 U 6/2013
CN 103922017 A 7/2014
(Continued)

OTHER PUBLICATIONS

International Search Report with Written Opinion for related Application No. PCT/US2019/054682 dated Jan. 23, 2020, (9 Pages).
(Continued)

*Primary Examiner* — Bob Zadeh
(74) *Attorney, Agent, or Firm* — Michael Best & Friedrich LLP

(57) ABSTRACT

A container and method of making the same is provided herein. The container may be configured to hold a dispensable material. The container can include a first sheet of a material and a second sheet of the material. The first sheet of material includes a folded portion across a first end of the first sheet. The second sheet of material includes a folded portion across a first end of the second sheet. The first sheet and the second sheet are bonded together across the folded portion of the first sheet and the folded portion of the second sheet to form a tip portion. The tip portion includes a passage between the folded portion of the first sheet of material and the folded portion of the second sheet of material.

18 Claims, 9 Drawing Sheets

(51) Int. Cl.

| | |
|---|---|
| ***B65D 35/08*** | (2006.01) |
| ***B65D 35/36*** | (2006.01) |
| ***B65D 75/58*** | (2006.01) |

(56) References Cited

U.S. PATENT DOCUMENTS

| | | | | |
|---|---|---|---|---|
| 4,085,886 | A * | 4/1978 | Nishioka | B65D 77/30 383/203 |
| 4,978,232 | A * | 12/1990 | Dunton | B65D 75/5866 222/572 |
| 5,026,194 | A | 6/1991 | Lewis | |
| 5,114,044 | A | 5/1992 | Spanek, Jr. | |
| 5,632,506 | A * | 5/1997 | Shellabarger | B60R 21/2171 280/743.1 |
| 5,931,346 | A | 8/1999 | Wallays | |
| 6,050,451 | A | 4/2000 | Hess, III et al. | |
| 6,126,315 | A | 10/2000 | Ichikawa et al. | |
| 6,179,165 | B1 | 1/2001 | Knight et al. | |
| 7,229,512 | B2 | 6/2007 | Streicher | |
| 7,395,642 | B2 | 7/2008 | Plourde et al. | |
| 7,757,894 | B2 | 7/2010 | Kluczynski | |
| 9,579,685 | B2 | 2/2017 | Starr et al. | |
| 2003/0044482 | A1 | 3/2003 | Stachowicz et al. | |
| 2004/0124210 | A1 | 7/2004 | Bartlein | |
| 2005/0170051 | A1 | 8/2005 | Folkmar | |
| 2009/0074333 | A1 | 3/2009 | Griebel et al. | |
| 2009/0127287 | A1 | 5/2009 | Faller | |
| 2011/0068119 | A1 | 3/2011 | Wurster, Jr. | |
| 2013/0277392 | A1* | 10/2013 | Dominguez | B65D 75/5866 383/41 |
| 2015/0028056 | A1 | 1/2015 | Massis | |
| 2015/0129609 | A1* | 5/2015 | Ciecorka | B65D 75/5883 222/107 |
| 2017/0341820 | A1 | 11/2017 | Folkmar | |
| 2018/0116244 | A1 | 5/2018 | Takakuta et al. | |

FOREIGN PATENT DOCUMENTS

| | | | |
|---|---|---|---|
| EP | 0074161 | A2 | 3/1983 |
| EP | 0 757 006 | B1 | 12/1999 |
| EP | 2 849 575 | B1 | 11/2017 |
| KR | 20060008303 | A | 1/2006 |
| WO | 9813272 | A1 | 4/1998 |

OTHER PUBLICATIONS

Office action issued from the Chinese Patent Office for related Application No. 2019800800154 dated May 16, 2022 (7 Pages).

Office action issued from the Chinese Patent Office for related Application No. 2019800800154 dated Dec. 5, 2022 (5 pages with translation).

Office action issued from the Chinese Patent Office for related Application No. 2019800800154 dated Mar. 29, 2023 (8 pages with translation).

* cited by examiner

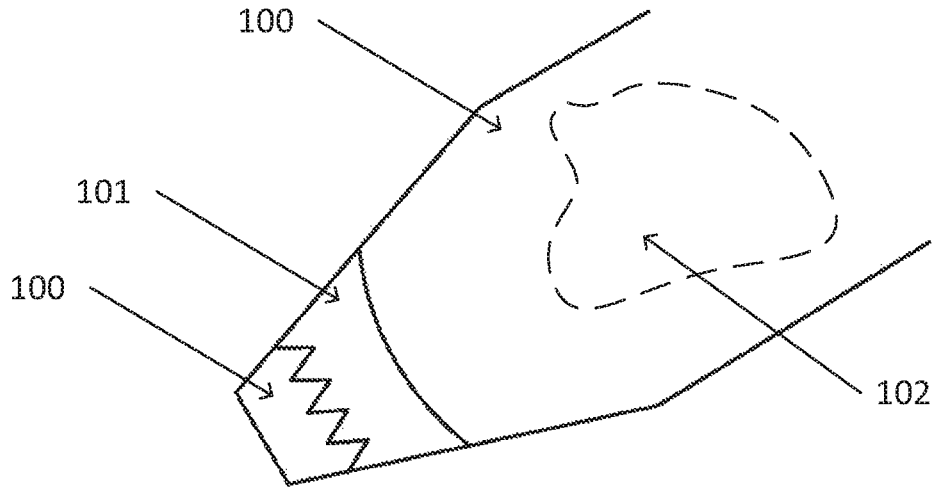
*FIG. 1*
*(Prior Art)*
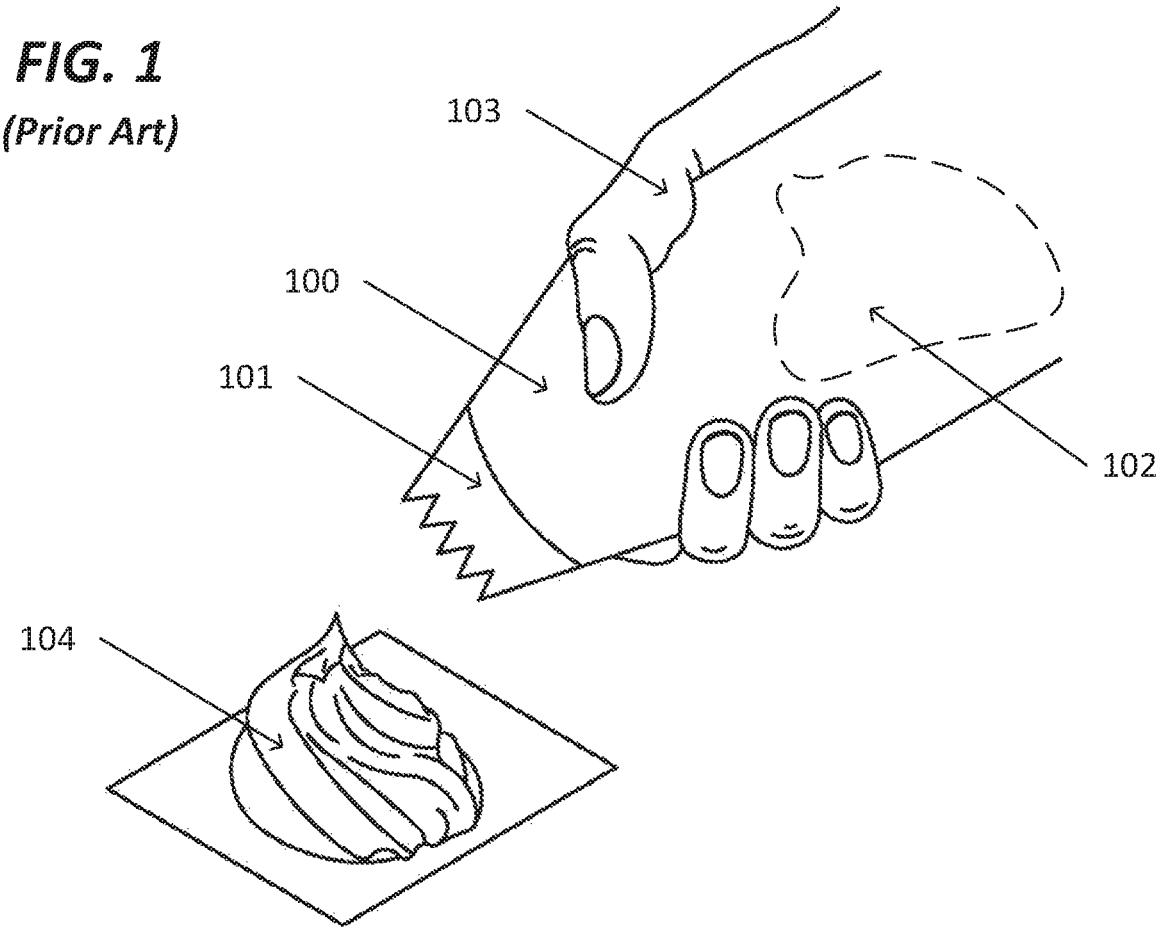

PASTRY BAG AND METHOD OF MANUFACTURING THEREOF

CROSS-REFERENCE TO RELATED APPLICATIONS

This application claims priority to co-pending U.S. Provisional Patent Application No. 62/741,154 filed on Oct. 4, 2018, the entire content of which is incorporated herein by reference.

FIELD OF THE INVENTION

The present invention is directed to containers, more particularly to flexible containers, and more particularly to a flexible bag and method for making the same for holding a dispensable material wherein the bottom portion that forms a dispensing tip includes multiple layers.

BACKGROUND OF THE DISCLOSURE

Food icings and toppings are commonly packaged in flexible plastic packaging. The end portion of the plastic packaging typically includes a separate tip that is connected to the bottom of the flexible packaging for the proper dispensing of material from the flexible container. The tip is used to control the shape and volume of material dispensed from the flexible container. The flexible walls of the container are not rigid enough to properly function as a dispensing tip. Examples of such tips that are secured to the bottom of a flexible container are disclosed in U.S. Pat. No. 7,757,894 and illustrated in FIG. 1. The use of a separate tip component for the flexible container results in added inventory and inventory management, costs, processing time, and complexity.

In view of the current state of the art, there is a need for an improved flexible plastic container that is more economical to produce, and which has a tip that can be easily opened and is integrally formed with the container.

SUMMARY

The invention provides, in one aspect, a container for holding and dispensing a food product, the container including a first layer of a material and a second layer of the material. In some embodiments the first layer of the material includes a folded portion across a first end of the first layer of the material. In some embodiments the second layer of the material includes a folded portion across a first end of the second layer of the material. In some embodiments the first layer of the material and the second layer of the material are bonded together across the folded portion of the first layer of the material and the folded portion of the second layer of the material to form a tip portion, the tip portion including a passage between the folded portion of the first layer of the material and the folded portion of the second layer of the material.

The invention provides, in another aspect, a method for manufacturing a container, the method including: providing a sheet of material, where a first fold line and a third fold line are spaced equally from opposite edges of the sheet of material, and where a second fold line bisects the first fold line and the third fold line; folding the sheet of material across the first fold line and across the third fold line; folding the sheet of material across the second fold line to form a folded sheet of material, where an edge of the folded sheet of material includes four layers of the sheet of material resulting from folding the sheet of material along the first fold line, the second fold line, and the third fold line; perforating the edge of the folded sheet of material; and sealing a first area and a second area. In some embodiments, the first sealing area and the second sealing area each bond folded portions of the folded sheet of material. In some embodiments, the first sealing area extends away from the edge of the folded sheet of material toward an opposite edge of the folded sheet of material. In some embodiments, second sealing area extends from the edge of the folded sheet of material at a location of the edge of the folded sheet of material spaced away from the first sealing area and toward the opposite edge of the folded sheet of material.

Other features and aspects of the invention will become apparent by consideration of the following detailed description and accompanying drawings.

BRIEF DESCRIPTION OF THE DRAWINGS

FIG. 1 illustrates a container according to an embodiment known in the art.

Figure 2:
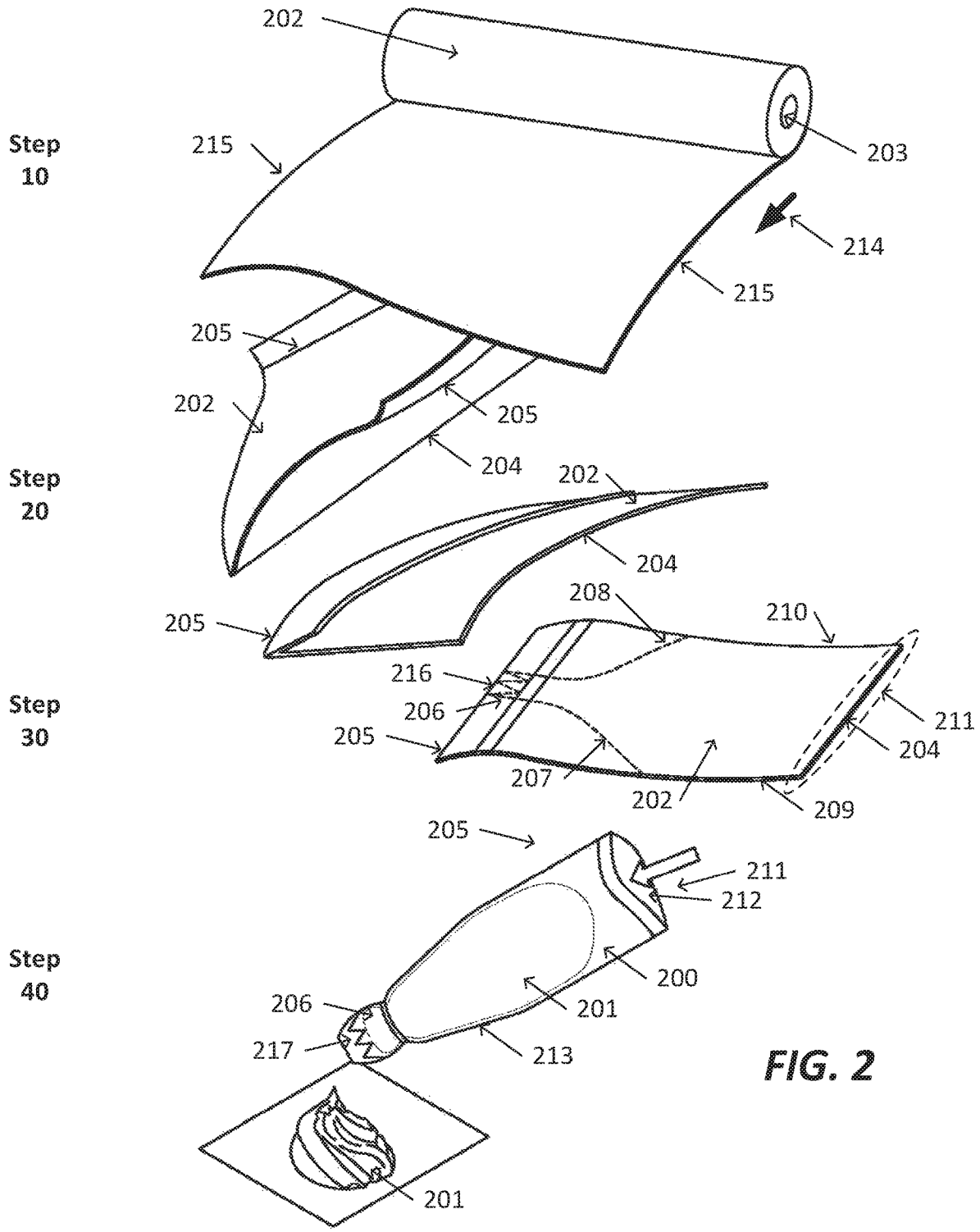
FIG. 2 illustrates a container and a method of producing the same according to an embodiment of the present disclosure.

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

FIG. 1 illustrates a container 100 according to an embodiment known in the art. Specifically, the container 100 containing a food product 102 is provided. The container 100 includes a tip 101 for dispensing the food product 102. The tip 101 is formed from a material that is different from a material from which the container 100 is formed. In other embodiments, the tip 101 may be manufactured from the same material as the container 100, but is of a greater thickness than the container 100 such that the tip 101 is more rigid than the container 100. In either case, when the container 100 and the tip 101 are manufactured, the container 100 is manufactured separately from the tip 101 and the tip 101 is adhered or otherwise secured to the outside of the container 100. In some embodiments, a portion of the container 100 may extend beyond the tip 101.

A user 103 may express the food product 102 from the container 100 by squeezing the container 100 and directing the food product 102 using the tip 101 as the food product 102 passes through the tip 101. The tip 101 may further be used to control the shape and/or volume of the food product 102 expressed from the container 100, as the container 100 has flexible walls which are not rigid enough to function as a dispensing tip. For example, the food product 102 may be expressed from the container 100 into a dollup of food product 104. In some embodiments, a portion of the container 100 extending beyond the tip 101 may be cut and/or removed to allow the food product 102 to pass from the container 100 and through the tip 101. Examples of such tips that are secured to the bottom of a flexible container are disclosed in U.S. Pat. No. 7,757,894. Disadvantages to such a configuration include added inventory and inventory management for the separate tip 101 and container 100, additional costs to manufacture, ship and package the separate components, processing time including an additional step of adhering or otherwise securing the tip 101 to the container 100, and complexity of the end product and manufacturing processes.

To address these and other disadvantages known in the art, Applicant surprisingly and unexpectedly found a container and method according to the embodiments disclosed herein. For example, FIG. 2 illustrates a container 200 and a method for manufacturing the container 200. As shown, the container 200 is provided with a container wall 213 defining the outside of the container 200 and a tip portion 206 at an end of the container 200. The container 200 may be filled with a food product 201. The food product 201 may include, for example, food material such as icing, filling, whipped topping, etc. The container wall 213 may be flexible to allow the container wall 213 to be squeezed, the squeezing thereby expressing the food product 201 from the container 200 through the tip portion 206.

Next, the method of manufacturing the container 100 will be described. However, the steps provided herein are not necessarily provided in the order in which they occur, but rather may be reordered as best fits a given manufacturing line and/or desired end-product. First, step 10 includes providing roll stock 202, preferably including a roll mount portion 203 such that the roll stock 202 can be unrolled into flat roll stock 202. The roll stock 202 may include a single or multiple materials selected from, for example, plastics, plastic films, plastic films made out of low-density polyethylene ("LDPE"), high density polyethylene ("HDPE"), polyester ("PET"), oriented polypropylene ("OPP"), polyolefin, biaxially-oriented polypropylene ("BOPP"), nylon, biaxially-oriented nylon, and laminated materials such as poly to poly, prop to poly, nylon to poly, prop to prop, pet to poly, and the like. The roll stock 202 may have a thickness of about 1 mil to about 6 mil, however, other thicknesses may be used.

Next, step 20 includes a single folding operation or multiple folding operations. For example, a first fold may occur along a first fold line 204, which may fold the roll stock 202 in half along a direction 214 that the roll stock 202 extends as the roll stock 202 is unrolled from the roll mount portion 203. Additionally, one or more secondary folds may occur at second fold lines 205. For example, each of the secondary folds along the second fold lines 205 may similarly occur along the direction 214 the roll stock 202 extends as the roll stock 202 is unrolled from the roll mount portion 203. However, unlike the first fold, in some embodiments the secondary folds may only fold over edge portions 215 of the roll stock 202, and may fold over a surface area of the roll stock 202 that is less than a surface area of the first fold.

Additionally, the secondary fold along the secondary fold lines 205 may be repeated. As shown in FIG. 2, the edge portions 215 are folded over once to double the thickness of the edge portions 215, however, the secondary folds may be repeated and be folded over two or more times to further increase the thickness of the edge portions 215. Repeating these secondary folds will increase the thickness, and therefore the rigidity, of the tip portion 206 when the process of manufacturing the container 200 is complete.

Step 30 may then be undertaken. Step 30 may include multiple cutting and/or sealing operations. In the embodiment provided in FIG. 2, an area of the second fold lines 205 will become the tip portion 206 and an area of the first fold line 204 will become a rear portion 211. In some embodiments, a first cutting operation will separate folded segments of the roll stock 202, which will be formed into individual containers 200. Since the container 200 of the illustrated embodiment is generally provided in a form that tapers in cross-sectional area from the rear portion 211 to the tip portion 206, a single tapering cut, for example, along an edge wall 210 may be provided. In other embodiments, such as the embodiment shown in FIG. 2, a first cut along the edge wall 210 and a second cut along a tapered wall 208 may be provided to form the generally tapering shape of the container 200. In addition, cuts may be provided along a tapered wall 207 and an edge wall 209. In a preferred embodiment, the cuts along the tapered wall 208 and the edge wall 210 may be reflections of the cuts along the tapered wall 207 and the edge wall 209 across the body of the container 200. A further cut may include a cut along the tip portion 206 to define a shape of the tip portion 206 of the container 200 for dispensing the food product 201.

The above-provided cuts along the tip portion 206, the tapered wall 207, the tapered wall 208, the edge wall 209, and the edge wall 210, collectively the "container edges," may further include bonding operations to seal the folds of the roll stock 202 provided in step 20 to one another. In some embodiments, the bonding operation may occur prior to, during, and/or after the cutting steps of step 30. In one non-limiting example, the container edges can be ultrasonic welded together or bonded together by a melted seal/seam. In another non-limiting example, one or more of the container edges can be adhesively connected together and then one or more of the remaining container edges can also be bonded together by ultrasonic welding or by a melted seal/seam. The bonding method used to bond together the container edges may be a single type of bonding or may include multiple types of bonding.

The cutting and/or sealing operation of the tip portion 206 may be different from the cutting and/or sealing operations of the rest of the container edges. For example, the tip portion 206 may include a tip pattern. For example, the tip pattern may include a plurality of chevrons spaced about an outer circumference of the tip portion 206. Such an embodiment is shown in FIG. 2. The method of forming the tip pattern may be accomplished by a laser (e.g., laser scoring, laser cutting, etc.), and/or by another electrical device (e.g., heated or resistive wire), and/or by a mechanical device (e.g., scoring wheel, punch cutting or scoring, knife cutting, etc.). During the step of forming the tip pattern, a portion below the formed tip pattern 216 (i.e., on the portion of the container 200 most distal from the rear portion 211) may be fully removed. Alternatively, the portion below the formed tip pattern 216 can remain connected to the container 200 for later removal (e.g., cutting or tearing off, etc.) prior to the dispensing of the food product 201 from the container 200. When the portion below the formed tip pattern 216 remains connected to the container 200, an opening in the tip portion 206 may optionally be sealed closed (e.g., adhesive seal, ultrasonic seam, melted seal, etc.) to close the tip portion 206 end of the container 200. When serrations and/or scoring are used on the tip portion 206, the serrations and/or scoring can be non-invasive (i.e., does not fully penetrate the roll stock 202). The serrations and/or scoring may form indented regions in the tip portion 206 that weaken the material of the container 200 and enable the container 200 to be manually torn along the scored region of the tip portion 206. The non-invasive scoring on the tip portion 206 may not cause an area of the tip portion 206 that includes the non-invasive scoring to be bonded together. The non-invasive scoring can be formed by a variety of processes such as, but not limited to, mechanical scoring (e.g., plated tooling that creates a scored impression on the material, a knifed roller wheel, a floating scoring knife, a cylinder with knife setup that runs over and/or floats on the roll stock 202 during the container 200 manufacturing process, laser scoring, etc.).

In some embodiments, when the portion formed below the tip pattern 216 is removed from the rest of the tip portion 206 via a cutting operation, a removable seal 217 and/or a cap may optionally be secured to the tip portion 206-end of the container 200 to close and seal the tip portion 206 of the container 200. The removable seal 217 may be provided if the tip portion 206 is formed by a cutting operation that has resulted in the tip portion 206 not forming a seal, and/or may be provided if serrations and/or scoring have weakened or otherwise compromised the strength of an existing seal about the tip portion 206. The removable seal 217 may be secured to the container 206, for example, by an adhesive. In some embodiments, the removable seal 217 (when used) is generally a single piece of flexible material (e.g., flexible plastic material, etc.) that is positioned to cover and to seal the tip portion 206 of the container 200. An exemplary embodiment of the removable seal 217 is shown in FIG. 2.

At the completion of step 30, the container 200 is formed. Then, in step 40, the container 200 is filled with the food product 201. The container 200 may be filled from the rear portion 211 of the container 200, through a cut or other aperture forming a rear opening 212 or otherwise formed through the container wall 213. In alternative embodiments, the container 200 may be filled with the food product 201 via an opening in the tip portion 206, or injected through other location(s) along the container wall 213. Once the container 200 is filled with the food product 201, the opening through which the food product 201 was inserted into the container 200 may be closed and/or sealed. For example, if the container 200 is filled using the rear opening 212, the rear opening 212 may be closed and sealed by a melted seam or ultrasonic seal; however, other sealing processes and/or devices can be used (e.g., adhesive, a piece of material connected over the rear opening 212, etc.).

When the container 200 of the illustrated embodiment is filled with the food product 201, a cross-sectional area of the container 200 is tapered from the tip portion 206 to the rear portion 211, and the container 200 has a generally conical shape when the container 200 is filled with the food product 201. As can be appreciated, the shape of the container 200 is non-limiting, as any permutation of folding, cutting and/or sealing operations may be undertaken in steps 20 and 30 to shape the container 200 as desired. Further, as illustrated in FIGS. 2-3, a cross-sectional shape and size of the tip portion 206 of the container 200 that is formed from the (overlapping) edge portions 215 is generally uniform; however, this is not required.

Figure 3:
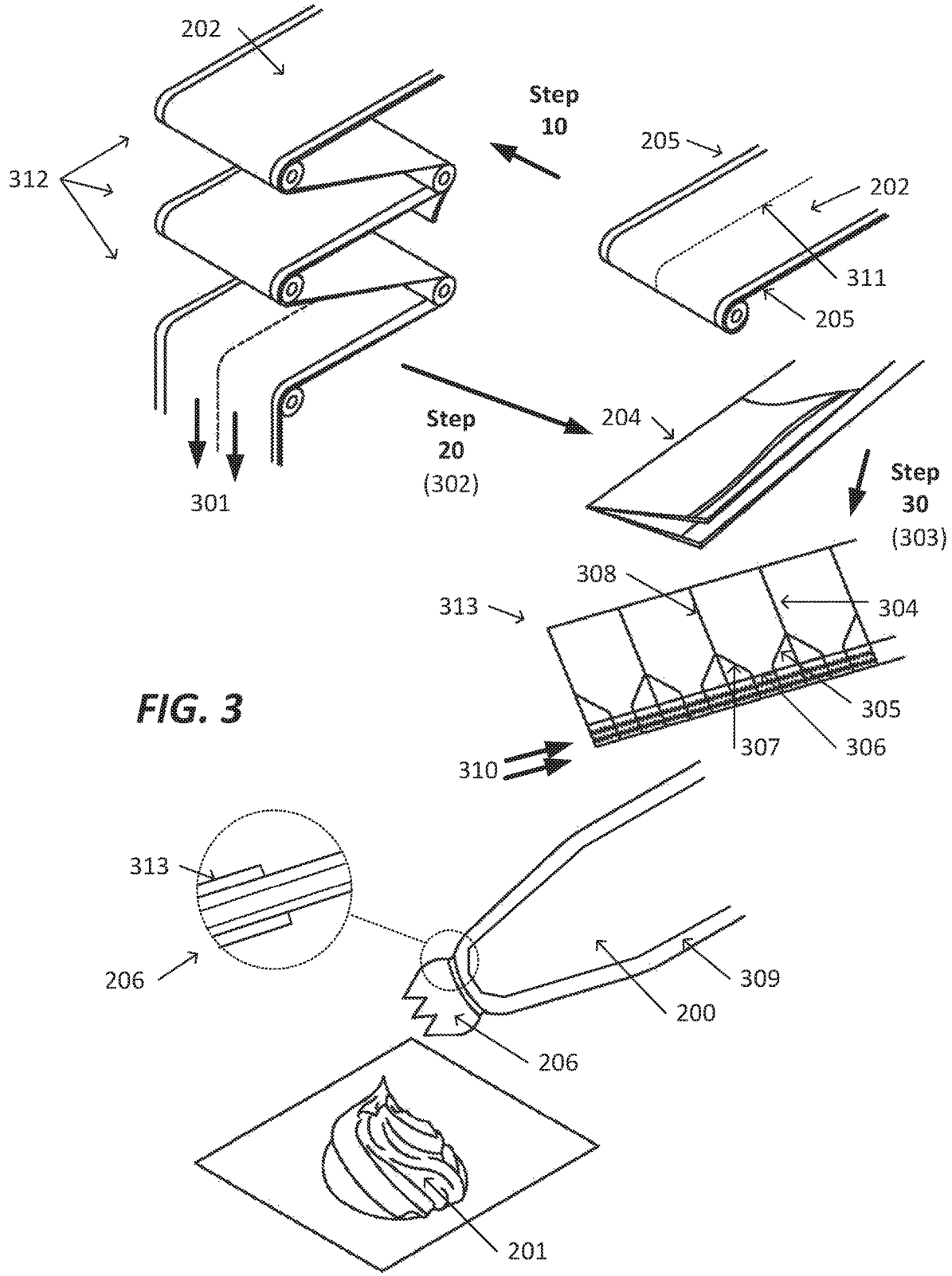
FIG. 3 illustrates a container and a method of producing the same according to an embodiment of the present disclosure.

FIG. 3 illustrates the container 200 and a method for manufacturing the container 200 that may be used with or as an alternative to the methods shown and described in reference to FIG. 2. In the method according to FIG. 3, the roll stock 202 is unrolled along a roller set 312. While the roll stock 202 is unrolled along the roller set 312, a first folding operation 301 and/or a second folding operation 302 may be undertaken. For example, the first folding operation 301 may include folding the roll stock 202 along the second fold lines 205, and the second folding operation 302 may include folding the roll stock 202 along the first fold line 204, also shown as a midline 311 of the roll stock 202 in FIG. 3. As such, the roller set 312 may be used to complete steps 10 and 20, outlined in detail above.

When steps 10 and 20 are complete, the roll stock 202 is transformed into folded roll stock 313, from which the container 200 can be cut away. Step 30 may be performed to remove the container 200 from the folded roll stock 313. The step 30 may include a cutting operation 303, which may include a first cut 304, a second cut 305, a third cut 306, a fourth cut 307, and a fifth cut 308. As provided in detail above with reference to FIG. 2, the cutting operation 303 may include a sealing operation and/or a scoring operation. For example, the third cut 306 may be performed across the tip portion 206, and further may include a scoring operation 310. Additionally or alternatively, a perforation operation and/or a laser scoring operation may be performed across the tip portion 206. In some embodiments, when the container 200 is separated from the folded roll stock 313 after the cutting operation 303 is complete, a sealed area 309 may be retained by the container 200 where the folded roll stock 313 sealingly connected to retain the food product 201 within the container 200.

FIG. 3 additionally shows a cross sectional view of the folded roll stock 313 across the tip portion 206, and further shows the second fold lines 205 in a folded position to illustrate a greater thickness of the container 200 across the tip portion 206.

Figure 4:
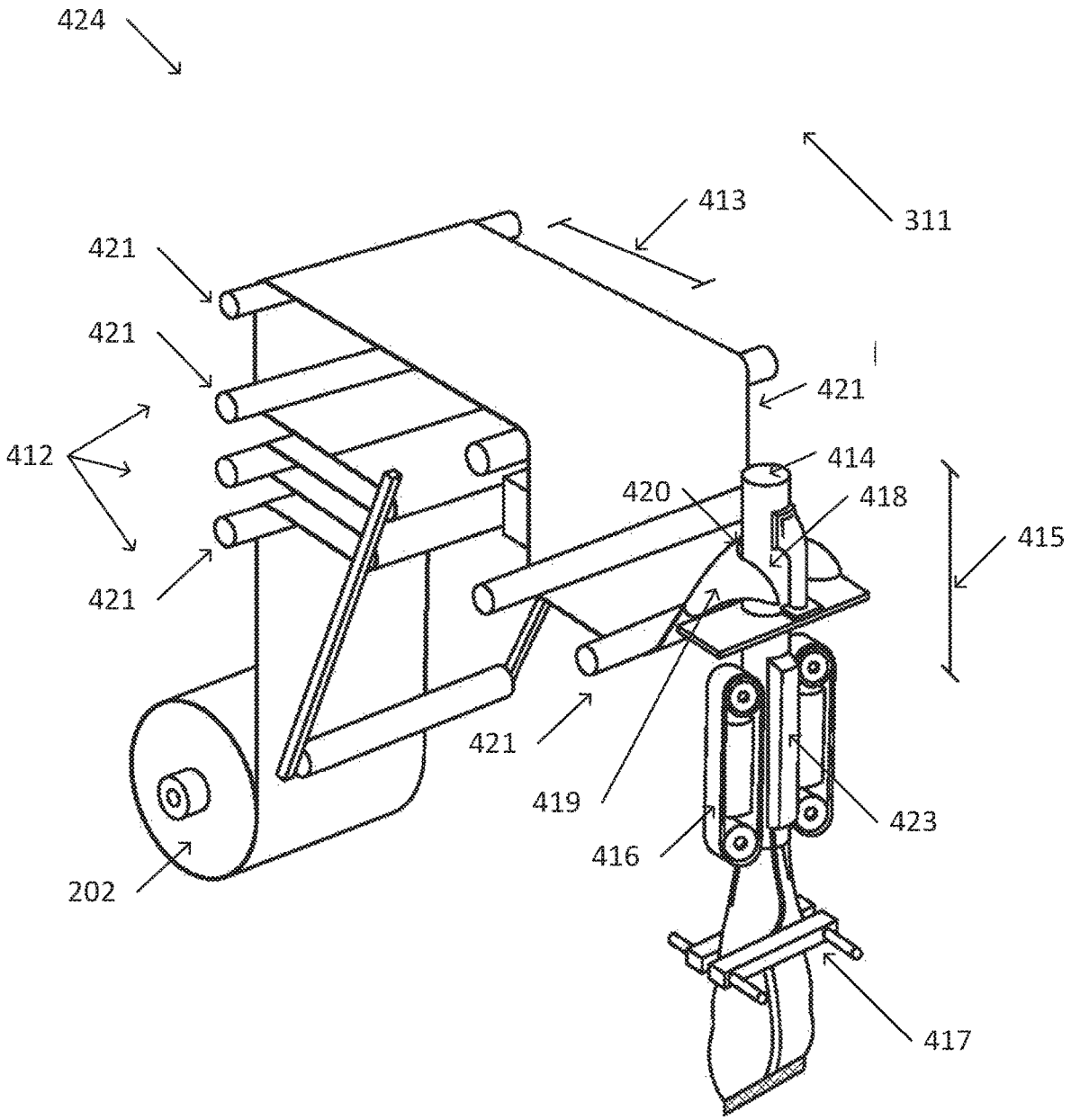
FIG. 4 illustrates a vertical packaging machine and a method of producing packaging according to an embodiment of the present disclosure.

FIG. 4 illustrates a vertical packaging machine 424 and a method for manufacturing the container 200 on the vertical packaging machine 424. In the vertical packaging machine 424, the roll stock 202 is unrolled across a plurality of rollers 421 in a roll stock positioning step 412. The roll stock positioning step 412 may orient the roll stock 202 for the folding, sealing, and/or cutting operations that may be subsequently performed on the roll stock 202.

A folding operation 413 may then be performed. In the folding operation 413, numerous folding operations may be performed, which may include but are not limited to folding the roll stock 202 across the second fold lines 205. After the folding operation 413 is performed, or alternatively without the folding operation 413 being performed, the roll stock 202 may pass over additional rollers 421, and be passed to a folding device 415. The folding device 415 may include a forming shoulder 419 positioned around a forming tube 418 and may further include a gap 420 positioned between the forming tube 418 and the forming shoulder 419. The folding device 415 may also include an advancing device 416 and a vertical sealing device 423. In some embodiments, the roll stock 202 may be pulled over the forming shoulder 419 and through the gap 420. As the roll stock 202 passes over the forming shoulder 419, the roll stock 202 is formed into a generally cylindrical shape. Then, the roll stock 202 is vertically sealed into the generally cylindrical shape with the vertical sealing device 423. In some embodiments, the vertical sealing device 423 may seal the tip portion 206. Also, in some embodiments, as the roll stock 202 passes over the forming tube 418, a filling device 414 positioned within the forming tube 418 fills the generally cylindrical shape with the food product 201.

Further, after the roll stock 202 passes through and out of the folding device 415, the roll stock 202 may be advanced to a horizontal sealing and cutting device 417. The horizontal sealing and cutting device 417 may perform a sealing and/or cutting operation, which may seal the food product 201 inside the generally cylindrical roll stock 202 by cutting and sealing successive ends of the containers 200 as the successive ends are cut from the roll stock 202.

Figure 5:
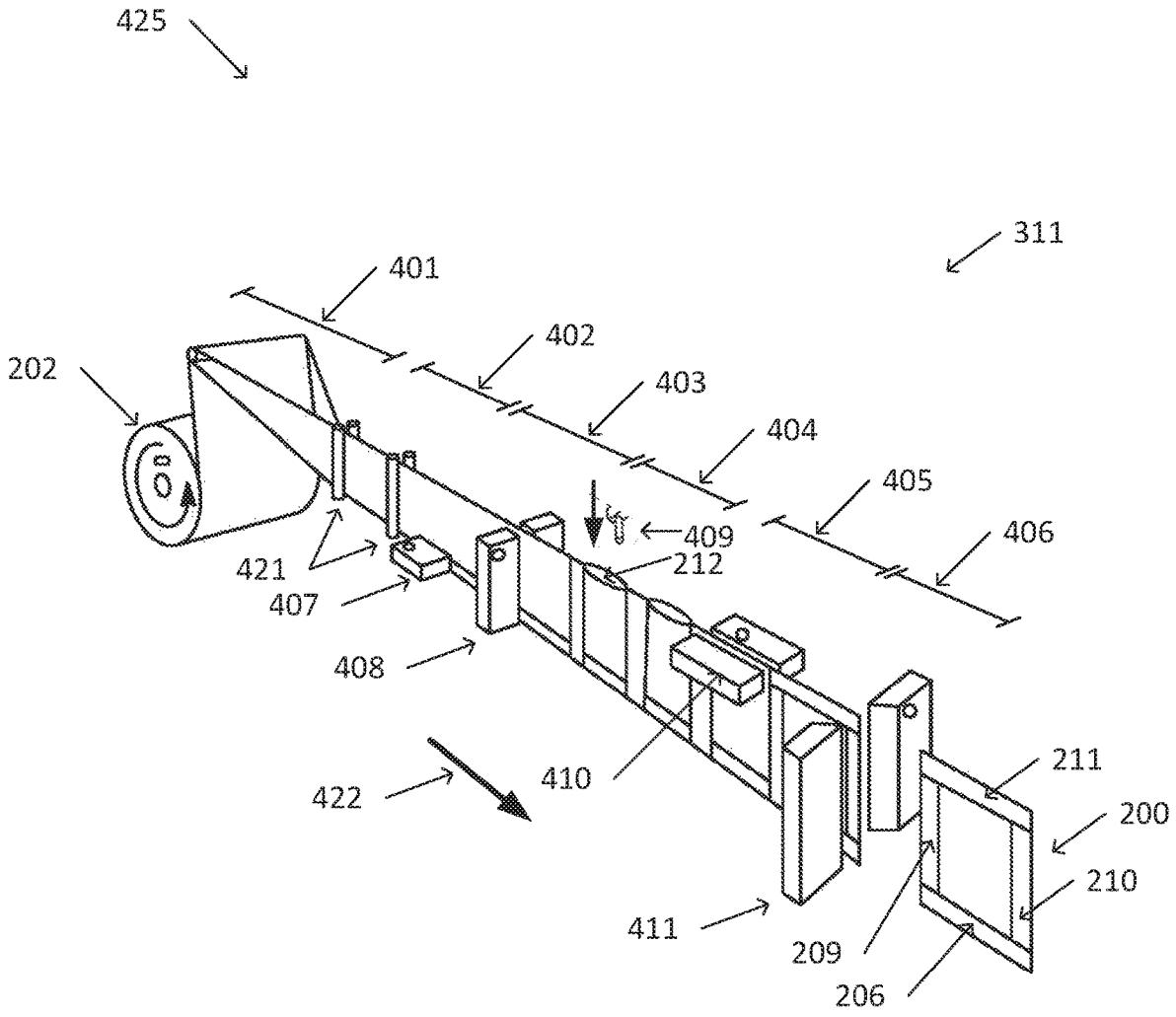
FIG. 5 illustrates a horizontal packaging machine and a method of producing packaging according to an embodiment of the present disclosure.

FIG. 5 illustrates a horizontal packaging machine 425 and a method for manufacturing the container 200 on the horizontal packaging machine 425. In the horizontal packaging machine 425, the roll stock 202 is unrolled across a plurality of the rollers 421 to a folding operation 401. The folding operation 401 may be optionally performed. In the folding operation 401, numerous folding operations may be performed, including but not limited to folding the roll stock 202 across the second fold lines 205.

After the folding operation 401 is performed, or alternatively without the folding operation 401 being performed, the roll stock 202 may pass along a direction of feed 422 over the rollers 421 and be passed to a first sealing operation 402 performed with a first sealing element 407. The first sealing operation 402 may seal the tip portion 206 of the container 200.

The roll stock 202 may then be passed along the direction of feed 422 to a second sealing operation 403 performed with a second sealing element 408. The second sealing element 408 may seal, for example, the edge wall 209 and the edge wall 210 of the container 200. Note that in the exemplary embodiment provided herein, the second sealing operation 403 may seal the container 200 along two, non-adjacent edges of the container 200.

The roll stock 202 may then be passed along the direction of feed 422 to a filling operation 404. In some embodiments, during the filling operation 404 the food product 201 may be injected into a cavity defined by the edge wall 209, the edge wall 210, and the tip portion 206, and injected through the rear opening 212. The filling operation 404 may be performing by injecting the food product 201 using a filling device 409. In some embodiments, a cutting operation may first be required to create the rear opening 212.

The roll stock 202 may then be passed along the direction of feed 422 to a third sealing operation 405 performed with a third sealing element 410. In some embodiments, the third sealing element 410 may seal and/or close the rear portion 211.

The food product 201 may now be enclosed completely within the container 200 while the container 200 is still attached to the roll stock 202. Therefore, the roll stock 202 may be passed along the direction of feed 422 to a cutting operation 406 that may be performed using a cutting element 411. The cutting element 411 may separate individual containers 200 from the roll stock 202, and further may perform scoring and/or perforation operations. For example, the cutting operation 406 may perform a perforation operation on the tip portion 206 of the container 200.

For clarity, a summarized method of producing the container 200 is provided below. In one non-limiting embodiment, the method of producing the container 200 includes the steps of:

(1) providing the roll stock 202 including a sheet of plastic flexible material;

(2) folding the roll stock 202 across the second fold lines 205 such that the roll stock 202 includes two of the edge portions 215 to thereby at least double the thickness of the edge portions 215 of the roll stock 202;

(3) bonding together (e.g., adhesive, ultrasonic bonding, melted seam, etc.) the edge portions 215 of the roll stock 202;

(4) folding the roll stock 202 in half such that the edge portions 215 overlap one another;

(5) forming a sealed area 309 (e.g., ultrasonic bonding, melted seam, etc.) from an end of the roll stock 202 including the edge wall 209 and/or the edge wall 210 toward an opposite end of the folded roll stock 313 so as to form the container 200;

(6) cutting the flexible container along the sealed area 309; and (7) forming a tip pattern or shape by cutting, scoring, or forming serrations on the overlapping edge portions 215 that form the tip portion 206 of the container 200.

FIGS. 6-9 illustrate the container 200 and a method of food product 201 preparation according to an embodiment of the present disclosure. In an exemplary embodiment, during the method of food product 201 preparation, the removable seal 217 is removed and/or the portion below the tip 216 of the container 200 is removed to allow the food product 201 within the container 200 to be dispensed from the container 200. FIGS. 6-9 illustrate the use of the container 200 to form a dollop of food product 104. In an exemplary embodiment, the dollup of food product 104 includes whipped topping. The tip portion 206 of the container 200 is illustrated as being integrally formed with the container 200, and thus no separate component is required to be connected to the container 200 to successfully dispense the food product 201 from the container 200. Due to a greater thickness from folding of the roll stock 202 (when compared to a thickness of the container wall 213), the tip portion 206 of the container 200 maintains a desired form during the dispensing of the food product 201 from the container 200. As such, a separate plastic tip is not required with the container 200 as disclosed herein.

Figure 6:
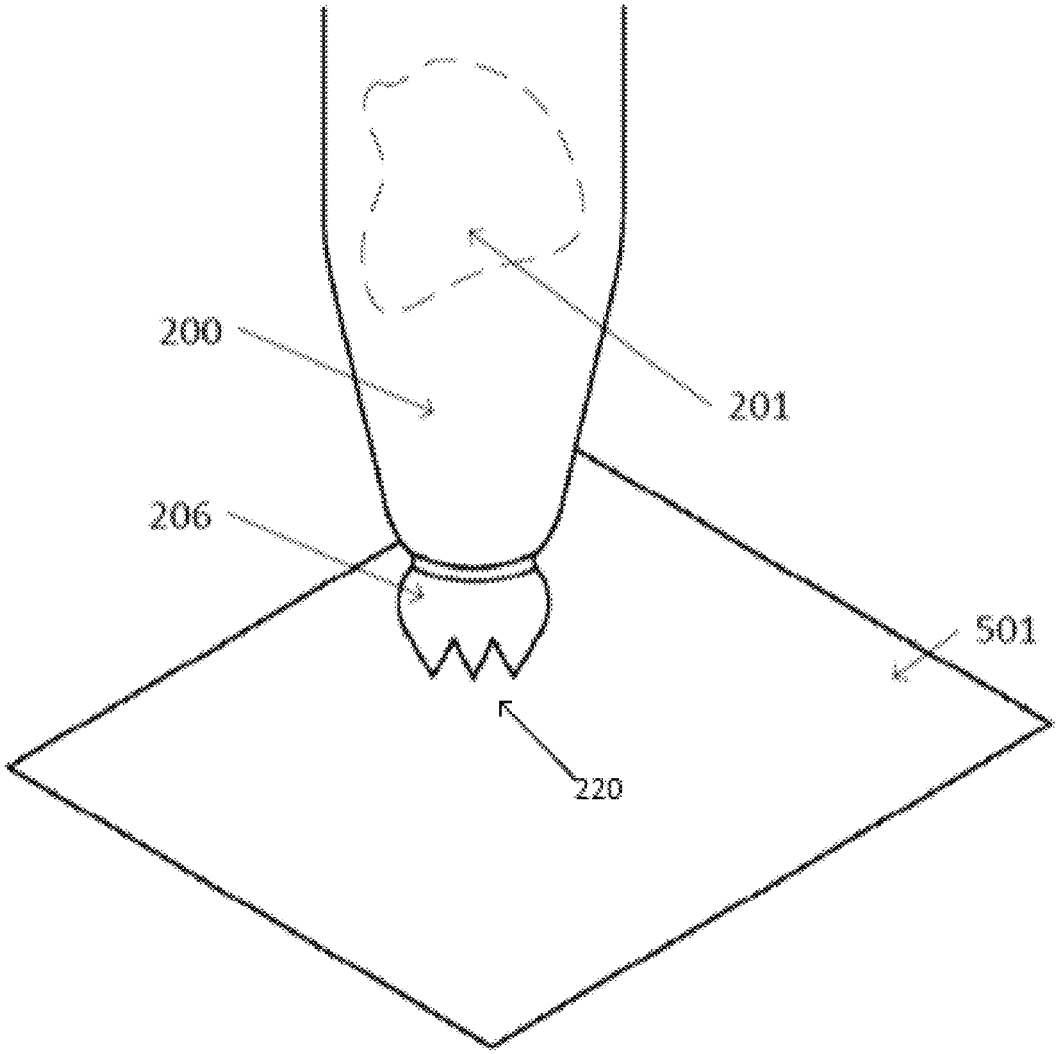
FIGS. 6-9 illustrate a container and a method of food product preparation using the same according to an embodiment of the present disclosure.
Figure 7:
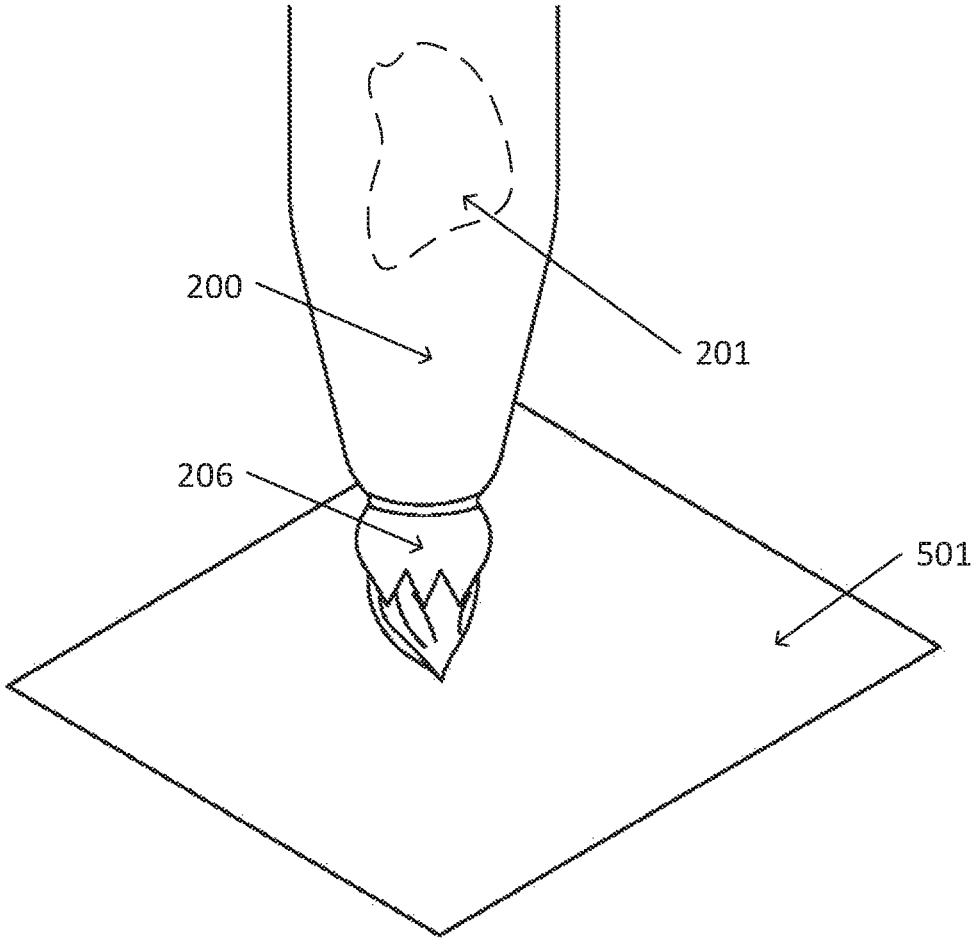
Figure 8:
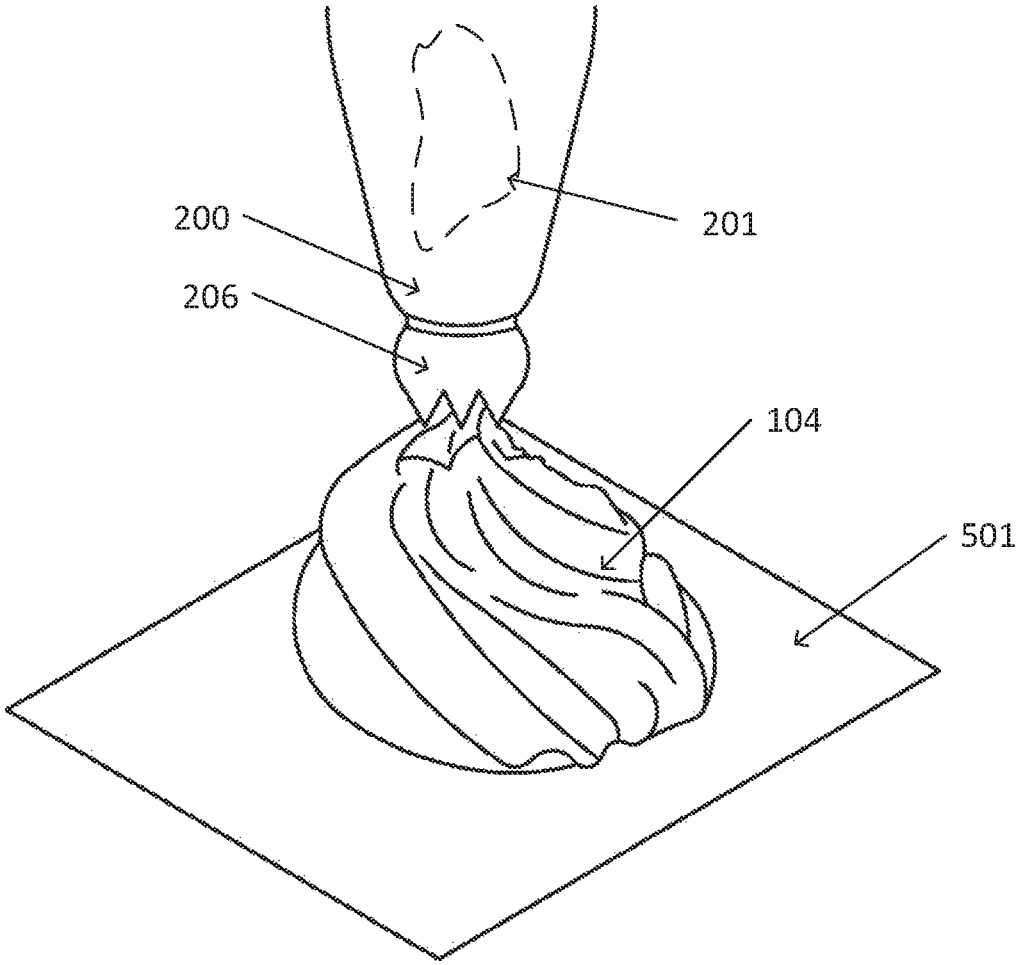
Figure 9:
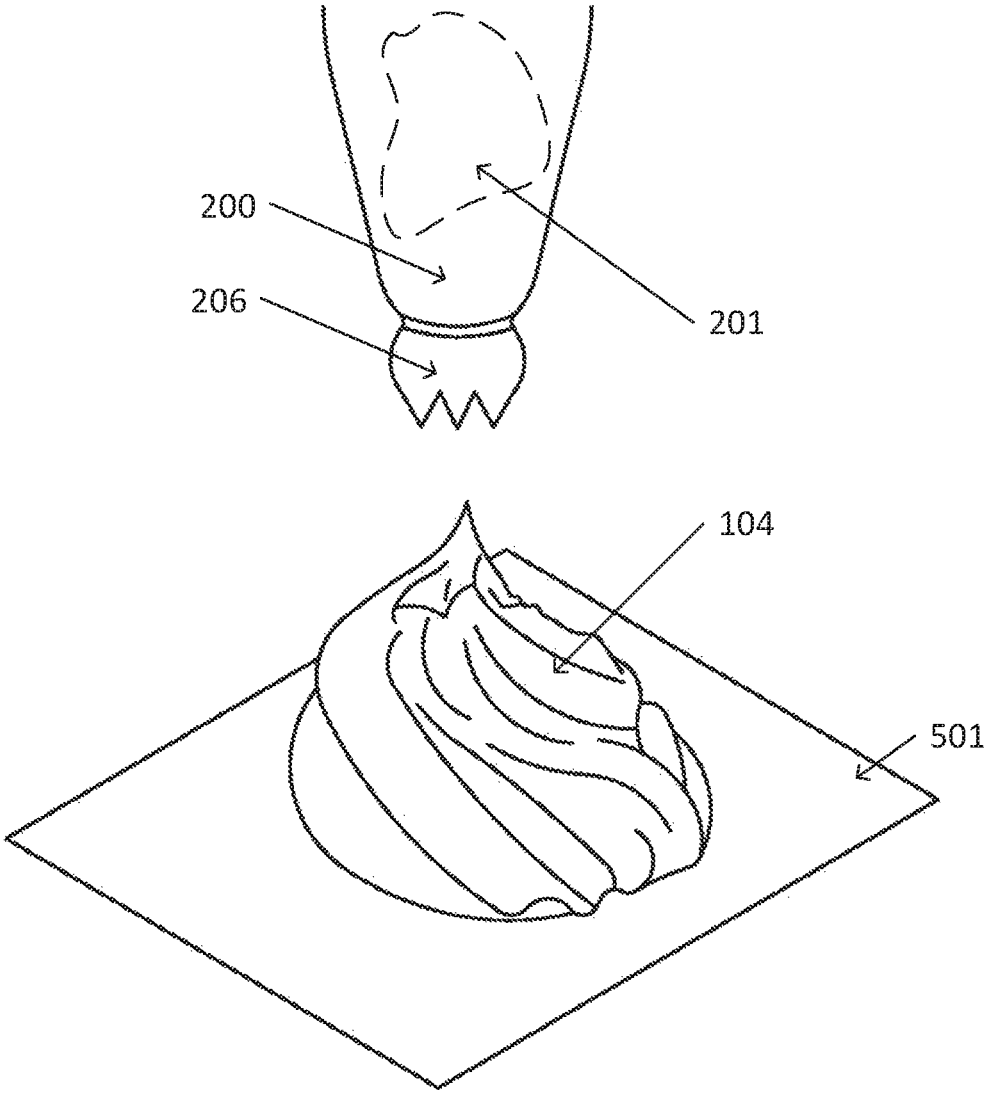

For example, FIG. 6 illustrates the food product 201 being expressed through a passage 220 from the tip portion 206 onto a food preparation area 501. As shown in FIG. 7, the tip portion 206 shapes the food product 201 as the food product 201 is pushed from the tip portion 206. Then, as shown in FIGS. 8 and 9, the dollup of food product 104 is placed on the food preparation area 501 after the food product 201 is expressed from the container 200.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall therebetween.

Various features of the invention are set forth in the following claims.

What is claimed is:

1. A container for holding and dispensing a food product, the container comprising;

a first layer of a material, and a second layer of the material, wherein the first layer of the material includes a folded portion across a first end of the first layer of the material, wherein the second layer of the material includes a folded portion across a first end of the second layer of the material, and wherein the first layer of the material and the second layer of the material are bonded together across the folded portion of the first layer of the material and the folded portion of the second layer of the material to form a tip portion, the tip portion including a passage between the folded portion of the first layer of the material and the folded portion of the second layer of the material.

2. The container of claim 1, further comprising a cap sealingly attached to the passage of the tip portion.

3. The container of claim 1, wherein the folded portion across the first end of the first layer of the material includes multiple folds such that a thickness of the tip portion is increased.

4. The container of claim 1, wherein the folded portion across the first end of the second layer of the material includes multiple folds such that a thickness of the tip portion is increased.

5. The container of claim 1, wherein the tip portion is formed to include a tip pattern, the tip pattern configured to change a cross sectional shape of the passage.

6. The container of claim 1, wherein the first layer of the material and the second layer of the material are ultrasonic welded together or are bonded together by a melted seal.

7. The container of claim 1, wherein a perforation is positioned through the first layer of the material and through the second layer of the material where the first layer of the material and the second layer of the material are bonded together across the folded portion of the first layer of the material and the folded portion of the second layer of the material, where the perforation passes across the passage, and wherein the passage is configured to be blocked by a portion of the first layer of the material and a portion of the second layer of the material until the portion of the first layer of the material and the portion of the second layer of the material is removed along the perforation.

8. The container of claim 1, wherein the tip portion and the container are a homogenous structure.

9. The container of claim 1, further comprising a first sealing area and a second sealing area, wherein the first sealing area bonds the first layer of the material to the second layer of the material, wherein the first sealing area extends from the tip portion toward an edge of the first layer of the material opposite of the tip portion and toward an edge of the second layer of the material opposite of the tip portion, and wherein the second sealing area extends from the tip portion on a side of the tip portion opposite of the first sealing area, toward the edge of the first layer of the material opposite of the tip portion and toward the edge of the second layer of the material opposite of the tip portion.

10. The container of claim 1, wherein the tip portion, the first layer and the second layer are only formed from the material.

11. A container for holding and dispensing a food product, the container comprising:

a container wall defining an outside of the container, the container wall formed from a single sheet of material;

a tip portion formed from the single sheet of material at an end of the container wall, the tip portion including a passage to allow for dispensing the food product from the container, and a tip pattern, the tip pattern configured to change a cross sectional shape of the passage, wherein the container wall is flexible and configured to be squeezed to dispense food product from the container through the tip portion, wherein the single sheet of material is folded along a first fold line opposite the tip portion to define a first layer of the material and a second layer of the material, and wherein the first layer of the material and the second layer of the material are folded along secondary fold lines at the tip portion, such that a thickness of the tip portion is greater than a thickness of the container wall.

12. The container of claim 11, further comprising a removable seal coupled to the tip portion to seal the passage.

13. The container of claim 11, wherein the container wall includes first and second edge walls extending from the first fold line, and wherein the first layer of the material and the second layer of the material are bonded together at the first and second edge walls.

14. A container for holding and dispensing a food product, the container comprising:

a container wall defining an outside of the container, the container wall formed from a single sheet of material folded along a first fold line to define a first layer of the material and a second layer of the material;

a tip portion formed from the single sheet of material opposite the first fold line, the tip portion including a passage to allow for dispensing the food product from the container, wherein the first layer of the material and the second layer of the material are folded along secondary fold lines at the tip portion, such that a thickness of the tip portion is greater than a thickness of the container wall.

15. The container of claim 14, wherein the container wall includes first and second edge walls extending from the first fold line, and wherein the first layer of the material and the second layer of the material are bonded together at the first and second edge walls.

16. The container of claim 15, wherein the container wall includes first and second tapered walls extending inwardly from the first and second edge walls to the tip portion.

17. The container of claim 14, further comprising a removable seal coupled to the tip portion to seal the passage.

18. The container of claim 14, wherein the tip portion includes four layers of the material.

* * * * *